US009409070B2

(12) United States Patent
Johnson

(10) Patent No.: US 9,409,070 B2
(45) Date of Patent: Aug. 9, 2016

(54) CLIP-ON GOLFING WEDGE HOLSTER

(76) Inventor: Tim A. Johnson, Columbus, OH (US)

( * ) Notice: Subject to any disclaimer, the term of this patent is extended or adjusted under 35 U.S.C. 154(b) by 69 days.

(21) Appl. No.: 13/365,188

(22) Filed: Feb. 2, 2012

(65) Prior Publication Data

US 2012/0196695 A1 Aug. 2, 2012

Related U.S. Application Data

(60) Provisional application No. 61/438,910, filed on Feb. 2, 2011.

(51) Int. Cl.

| | |
|---|---|
| ***A63B 55/00*** | (2015.01) |
| *A45F 5/02* | (2006.01) |
| *A63B 55/10* | (2006.01) |

(52) U.S. Cl.

CPC ..... *A63B 55/00* (2013.01); *A45F 5/021* (2013.01); *A63B 55/10* (2013.01); *A63B 2208/00* (2013.01); *A63B 2225/68* (2013.01)

(58) Field of Classification Search

CPC ..... A63B 55/07; A63B 55/008; A63B 57/00; A63B 55/00; A63B 55/10; A63B 2208/00; A63B 2225/68; A45F 5/14; A45F 2200/0591; A45F 2200/0575; A45F 2004/00; A45F 5/021; A45F 2200/0566

USPC ..... 473/282; 206/315.2, 315.4; 150/160; D3/271.9, 293, 303; 24/3.12; 224/904, 224/269, 664–667, 677–678; D21/796; D6/552

See application file for complete search history.

(56) References Cited

U.S. PATENT DOCUMENTS

| | | | | | |
|---|---|---|---|---|---|
| 2,589,126 | A | * | 3/1952 | Payne | 224/247 |
| 2,871,499 | A | * | 2/1959 | Gardner | 15/246 |
| 2,879,819 | A | * | 3/1959 | Turnbull | 206/315.4 |
| 3,967,667 | A | * | 7/1976 | Robinson | 206/315.6 |
| 4,838,416 | A | * | 6/1989 | Carman | 206/315.2 |
| 4,852,782 | A | * | 8/1989 | Wu et al. | 224/661 |
| D312,170 | S | * | 11/1990 | Carman | D3/255 |
| D345,052 | S | * | 3/1994 | Stokke et al. | D3/228 |
| 5,361,958 | A | * | 11/1994 | Fiegel et al. | 224/274 |
| 5,878,460 | A | * | 3/1999 | Bruce | 15/160 |
| 7,320,401 | B1 | * | 1/2008 | Chandler | 206/315.2 |
| 7,356,868 | B1 | * | 4/2008 | Herrmann | 15/106 |
| 2009/0145938 | A1 | * | 6/2009 | Kahn | 224/183 |
| 2012/0178547 | A1 | * | 7/2012 | Famulari | 473/282 |

* cited by examiner

*Primary Examiner* — Stephen Blau

(74) *Attorney, Agent, or Firm* — MIRACLE IP; Bryce D. Miracle

(57) ABSTRACT

A clip-on golfing club holster allows a golfer to hold a golf club at the golfer's side after use. The holster directs the shaft of the club out of the way of the golfer so that, for example, when the golfer uses a wedge to get on the green, the golfer may holster the wedge and move to putting while keeping the wedge close at hand. The holster includes a clip to attach the club to a golfer's belt and a head cover designed so that the golf club hosel hangs behind the golfer and out of the way. With the weight of the golf club head supported by the holster, there may not be any discomfort with carrying the club in the holster.

1 Claim, 2 Drawing Sheets

CLIP-ON GOLFING WEDGE HOLSTER

CROSS-REFERENCE TO RELATED APPLICATIONS

This application claims the benefit of priority of U.S. provisional patent application No. 61/438,910, filed Feb. 2, 2011, the contents of which are herein incorporated by reference.

BACKGROUND OF THE INVENTION

The present invention relates to golfing accessories and, more particularly, to a wedge head cover attachable to a user's belt for holding a wedge after chipping or practicing golf.

After chipping onto the green, a golfer often lays their wedge down around the green, sometimes resulting in lost or misplaced clubs. Also, when golfers are practicing their short game, their golf bag may be away from them and there may not be a convenient place to store their wedge between shots, while gathering balls, or if switching to putting.

As can be seen, there is a need for an apparatus to conveniently store a golfer's wedge.

SUMMARY OF THE INVENTION

For the foregoing reasons, what is needed is to provide a holder for a golf club, particularly a wedge in which the user can attach to his or her person as opposed to placing it on the ground while in the putting phase. Generally speaking, the invention comprises a club holster which houses the head of the club and is attached to the user's belt, allowing the club to extend downward from the user's hip.

In a version of the invention, an apparatus for holding a golf club is provided. The apparatus comprises a club holster having an inner pocket, an opening adapted to receive at least a portion of a golf club head into the inner pocket, a plurality of brushes disposed about the opening, and a clip on a side of the club holder, the clip adapted to affix the apparatus to the belt of a golfer, wherein the inner pocket comprises a flexible liner made of a rubber material, the inner pocket narrowing in dimension extending lengthwise away from the opening, thereby while inserting the club head, the narrowing pocket configuration increasingly provides a greater grip as the head is seated within the pocket and wherein the opening is disposed at an angle from about 5 to about 40 degrees, permitting a golf club shaft to extend behind the golfer when the golf club head is disposed inside the opening.

Still other versions, benefits and advantages of the invention will become apparent to those skilled in the art to which it pertains upon a reading and understanding of the following detailed specification.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a clip-on golfing club holster that allows a golfer to hold a golf club at the golfer's side after use. The holster directs the shaft of the club out of the way of the golfer so that, for example, when the golfer uses a wedge to get on the green, the golfer may holster the wedge and move to putting while keeping the wedge close at hand. The holster includes a clip to attach the club to a golfer's belt and a head cover designed so that the golf club hosel hangs behind the golfer and out of the way. With the weight of the golf club head supported by the holster, there may not be any discomfort with carrying the club in the holster.

Figure 1:
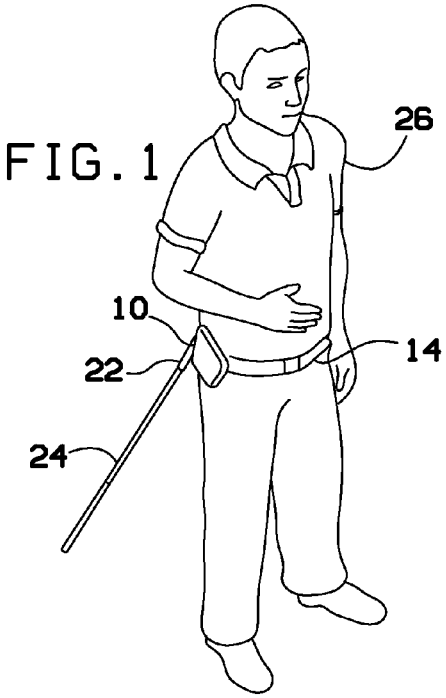
FIG. 1 is a perspective front view of a wedge holster, in use, according to an exemplary embodiment of the present invention.
Figure 2:
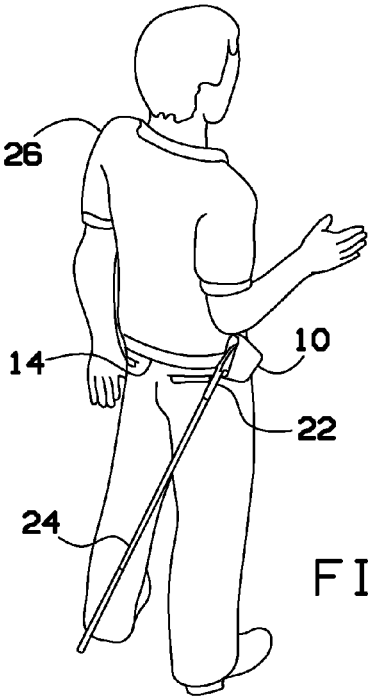
FIG. 2 is a perspective side view of the wedge holster of FIG. 1, in use.
Figure 3:
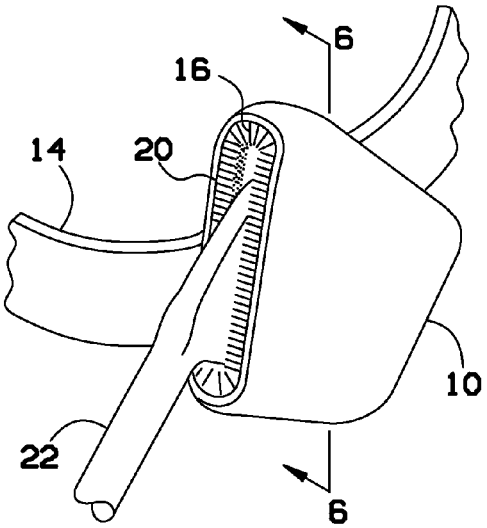
FIG. 3 is a perspective view of the wedge holster of FIG. 1, attached to a belt.
Figure 4:
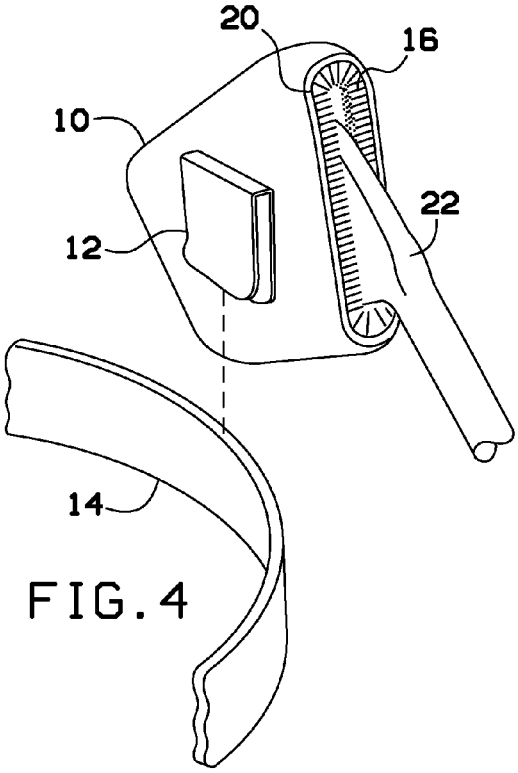
FIG. 4 is a perspective view of the wedge holster of FIG. 1, removed from a belt.
Figure 5:
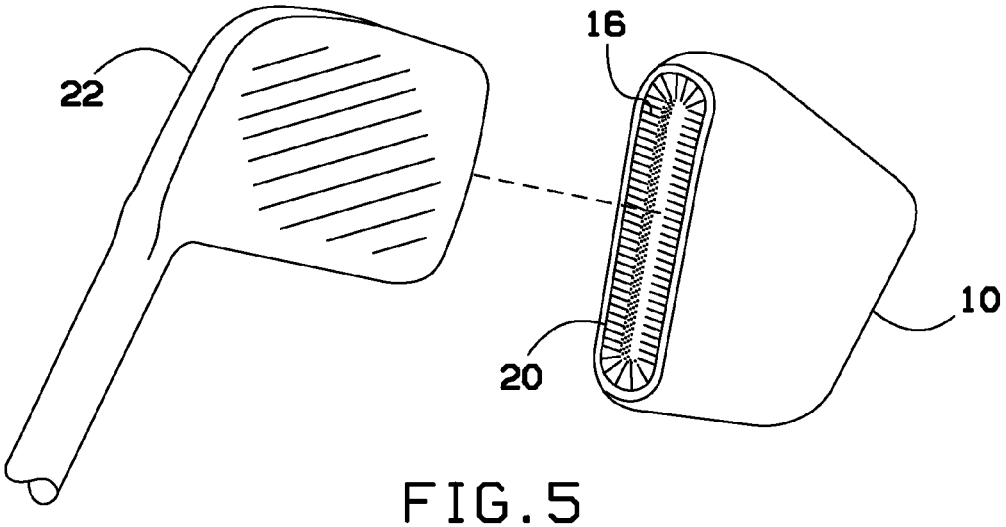
FIG. 5 is a perspective view of the wedge holster of FIG. 1 with a golf club removed.
Figure 6:
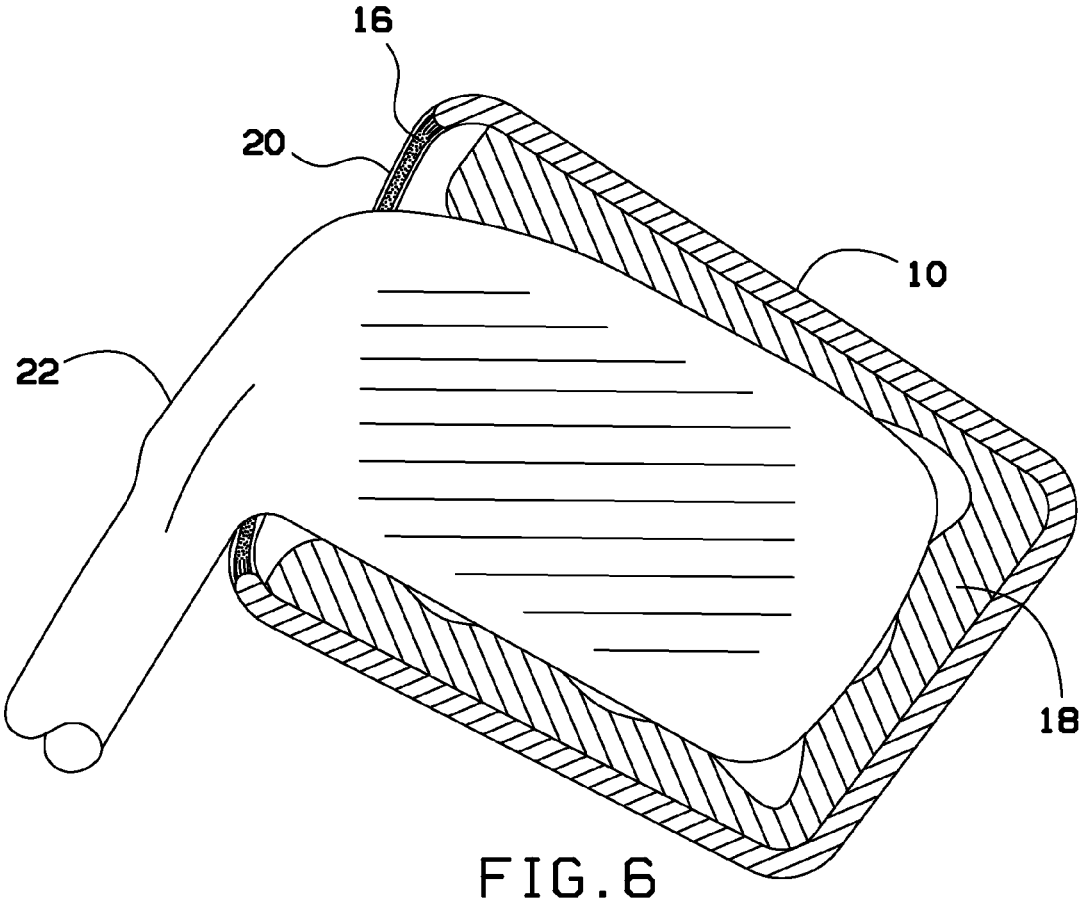
FIG. 6 is a cross-sectional view taken along line 6-6 of FIG. 3.

Referring now to FIGS. 1 through 6, a golf club 24 may be carried by a golfer 26 in a club holster 10. The wedge holster may include an opening 20 adapted to accept a golf club head 22. A clip 12 may be attached to the club holster 10 to allow a user to keep the club holster 10 on a belt 14.

The opening 20 of the club holster 10 may be angled from about 5 to about 40 degrees, relative to the ground, so that the golf club 24 extends behind the golfer 26 when the golf club head 22 is inserted into the club holster 10. This may permit the golfer 26 to continue playing without the golf club 24 being in his or her way.

The club holster 10 may include opening brushes 16 disposed about the opening 20 of the club holster 10. The brushes 16 may help secure the golf club head 22 inside the opening 20 and may also brush dirt and debris from the club during use.

The club holster 10 may include a liner 18. The liner 18 may be a material that may help frictionally retain the golf club head 22 inside the club holder 10. For example, the liner 18 may be made of a flexible rubber.

The club holster 10 may be designed to hold a golfer's wedge club, for example. In this embodiment, after chipping up on the green, instead of laying the wedge on the ground, to start putting, the golfer would simply slide the wedge head into the club holster 10 and the club is on the golfer's hip and out of the way, thus no chance of leaving or losing your wedge. In other embodiments, the club holster 10 may be designed for other clubs, such as a putter.

The club holster 10 may be made from various materials. For example, the club holster 10 may be made of plastic, metal, or a composite material. Typically, the club holster 10 may be made of plastic. The clip 12 may be made of a strong, resilient material, typically metal, such as stainless steel. The brushes 16 of the club holster 10 may be made of plastic, rubber, or a natural or synthetic bristle material, for example.

It should be understood, of course, that the foregoing relates to exemplary embodiments of the invention and that modifications may be made without departing from the spirit and scope of the invention as set forth in the following claims.

What is claimed is:

1. An apparatus for holding a golf club, comprising:

(a) a club holster having an inner pocket, an opening adapted to receive at least a portion of a golf club head into the inner pocket, a plurality of brushes disposed only about the opening, and a clip on a side of the club holder, the clip adapted to affix the apparatus to the belt of a golfer;

(b) wherein the inner pocket comprises a flexible liner made of a rubber material, the inner pocket narrowing in dimension extending lengthwise away from the opening, thereby while inserting the club head, the narrowing pocket configuration increasingly provides a greater grip as the head is seated within the pocket; and (c) wherein the opening is disposed at an angle from about 5 to about 40 degrees, permitting a golf club shaft to extend behind the golfer when the golf club head is disposed inside the opening.

* * * * *